US007357689B2

(12) United States Patent
Campbell

(10) Patent No.: US 7,357,689 B2
(45) Date of Patent: Apr. 15, 2008

(54) AUTOMATIC INFLATION DEVICE HAVING A MOISTURE ACTIVATED TRIGGER AND RELEASE SYSTEM WITH REDUCED FORCE APPLIED TO THE DEGRADABLE ELEMENT

(76) Inventor: Richard A. Campbell, 2719 Trevor Dr., Huntsville, AL (US) 35802

( * ) Notice: Subject to any disclaimer, the term of this patent is extended or adjusted under 35 U.S.C. 154(b) by 180 days.

(21) Appl. No.: 11/037,170

(22) Filed: Jan. 19, 2005

(65) Prior Publication Data

US 2006/0160444 A1 Jul. 20, 2006

(51) Int. Cl.
*B63C 9/15* (2006.01)

(52) U.S. Cl. ..... 441/95

(58) Field of Classification Search ..... 441/93, 441/95, 97, 8, 10; 222/5; 24/602
See application file for complete search history.

(56) References Cited

U.S. PATENT DOCUMENTS

| | | | | |
|---|---|---|---|---|
| 2,946,484 | A | 7/1960 | Stoner | |
| 3,059,814 | A | 10/1962 | Poncel et al. | |
| 3,091,782 | A | 6/1963 | Sclafani | |
| 3,426,942 | A | 2/1969 | McMains et al. | |
| 3,579,964 | A | 5/1971 | Ohlstein | |
| 3,702,041 | A | 11/1972 | Podolan | |
| 3,757,371 | A | 9/1973 | Martin | |
| 3,779,004 | A * | 12/1973 | Gloeckler | 59/93 |
| 3,809,288 | A | 5/1974 | Mackal | |
| 3,815,783 | A | 6/1974 | Hirata | |
| 3,910,457 | A | 10/1975 | Sutliff et al. | |
| 3,934,292 | A | 1/1976 | Mulderrig | |
| 3,997,079 | A | 12/1976 | Niemann | |
| 4,191,310 | A | 3/1980 | Bernhardt et al. | |
| 4,223,805 | A | 9/1980 | Mackal | |
| 4,260,075 | A * | 4/1981 | Mackal | 222/5 |
| 4,267,944 | A | 5/1981 | Mackal | |
| 4,353,936 | A | 10/1982 | Nozaki et al. | |
| 4,382,231 | A | 5/1983 | Miller | |
| 4,436,159 | A | 3/1984 | Revay | |
| 4,500,014 | A | 2/1985 | Zimmerly | |
| 4,513,248 | A | 4/1985 | Miller | |
| 4,627,823 | A | 12/1986 | Mackal | |
| 4,848,262 | A * | 7/1989 | Freeman | 114/367 |
| 4,972,971 | A | 11/1990 | Janko et al. | |
| 5,035,345 | A | 7/1991 | Janko et al. | |
| 5,076,468 | A | 12/1991 | Mackal | |
| 5,419,725 | A | 5/1995 | Crowder et al. | |

(Continued)

FOREIGN PATENT DOCUMENTS

| | | |
|---|---|---|
| EP | 0 598 601 | 5/1994 |

*Primary Examiner*—Ed Swinehart
(74) *Attorney, Agent, or Firm*—B. Aaron Schulman; Stites & Harbison PLLC

(57) ABSTRACT

An automatic inflation device is provided which features a trigger and release system for use in an armed-static condition and which is advantageous in that it significantly reduces the force acting on a dissolvable tablet in the release mechanism and thereby extends the operating life of the automatic inflation device in the presence of high humidity. The device preferably operates using a male and female housing with a manifold to allow expanding gas to escape and a compressed concentric spring encompassing a $CO_2$ cylinder subassembly, and the triggering sequence includes a degradable element which triggers the inflation device upon losing its structural integrity, which causes an extending spring to drive the $CO_2$ cylinder toward a puncture pin.

21 Claims, 11 Drawing Sheets

U.S. PATENT DOCUMENTS

| | | | |
|---|---|---|---|
| 5,582,494 | A | 12/1996 | Cook |
| 5,601,124 | A | 2/1997 | Weinheimer et al. |
| 5,694,986 | A | 12/1997 | Weinheimer et al. |
| 5,775,358 | A | 7/1998 | Fawcett, Jr. et al. |
| 5,816,878 | A | 10/1998 | McNamee |
| 6,394,867 | B1 | 5/2002 | Bianco |
| 6,561,863 | B1 | 5/2003 | Campbell |
| 6,589,087 | B2 | 7/2003 | Mackal |
| 6,659,824 | B1 | 12/2003 | McCormick |
| 2003/0049981 | A1 | 3/2003 | Mackal et al. |
| 2003/0049982 | A1 | 3/2003 | Mackal et al. |
| 2004/0124209 | A1 | 7/2004 | Mackal et al. |

* cited by examiner

AUTOMATIC INFLATION DEVICE HAVING A MOISTURE ACTIVATED TRIGGER AND RELEASE SYSTEM WITH REDUCED FORCE APPLIED TO THE DEGRADABLE ELEMENT

FIELD OF THE INVENTION

The present invention relates generally to an automatic inflation device featuring a trigger and release system, and in particular to an automatic inflation device which uses a degradable, moisture-activated trigger element that starts a releasing sequence that punctures a pressurized canister to release a compressed fluid, yet which has less force applied on the degradable element so as to prevent against unwanted triggering of the inflation mechanism. In the illustrated embodiments the system is used with a $CO_2$ cartridge for automatically filling an inflatable device such as a life jacket or other personal floatation device, or other life-saving or emergency-signaling equipment.

BACKGROUND OF THE INVENTION

Presently, there exist many types of inflators designed to inflate inflatable devices such as life jackets, life vests, emergency signaling equipment, and the like. Inflators typically comprise a body for receiving the neck of a pressurized container of compressed fluid such as carbon dioxide. A puncture pin is held within the body of the inflator for piercing the friable seal of the container to permit the compressed fluid therein to flow into a manifold and then into the device to be inflated. Typically, a manually movable lever is connected to the puncture pin such that the puncture pin pierces the friable seal of the container upon a jerking motion of the lever.

In the case of an inflatable life jacket, manually operated inflators require an intention by the wearer to activate the inflator to release the compressed fluid to inflate the life jacket. If the wearer is disabled or unconscious, he or she may be unable to manually activate the inflator.

In response to this problem, automatic inflators have been created to, singly or in combination with a manual lever, automatically inflate a device when exposed to a fluid such as water. Some of these automatic inflators utilize probes or a conductor mounted in the inflatable device. The probes or conductors form a part of an electrical circuit used to automatically drive a puncture pin into the pressurized fluid container. When the housing is fully submerged in water, a circuit is closed between the probes which supplies electric power to the actuating mechanism.

While such inflators may be an improvement over entirely manually activated inflators, care must be taken to prevent water from entering the circuitry and cause premature activation due to a splash of water when the housing is not fully immersed in water or from the housing being in a very moist environment.

In response to this realized inadequacy of the prior art manual inflators, water activated automatic inflators were developed which, when exposed to a fluid such as water, automatically activated the piercing pin of the inflator when immersed in water thereby causing inflation of the inflatable device. In these devices, the automatic inflator includes a water-activated trigger assembly wherein a water-destructible element retains a spring loaded actuator pin in alignment with a puncture pin. Upon exposure to water, the element dissolves, and the spring-loaded actuator pin is released to forcibly move from the cocked position to strike the puncture pin. Upon striking the puncture pin, the pin fractures the seal of the container thereby allowing the compressed gas to escape and inflate the inflatable device. A majority of these automatic inflation devices utilize a water-soluble tablet to trigger the activation of the automatic inflation device. These tablets are similar to an aspirin both in appearance and physical properties. Two of their physical characteristics that enable them to be used for this purpose are; 1) they quickly lose their structural integrity when exposed to water 2) they are able to with stand considerable forces without fracturing when kept relatively dry.

The tablet, which consists of a desiccant material, immediately looses its ability to sustain any load when-submerged in water. However, when exposed to high humidity environmental conditions, the tablet will absorb moisture which produces a progressive degradation of the tablets load supporting properties. The rate at which the moisture is absorbed is a function of the relative humidity and ambient temperature. The amount of moisture that has been absorbed is a function of the length of time the tablet is subjected to the particular environmental conditions. The fracture strength of the tablet is directly related to the amount of moisture that has been absorbed. For example; if two identical tablets are simultaneously subjected to the same high humidity ambient conditions and physically subjected to the same type of compressive load only the magnitude of the load on one tablet is greater than that on the other, the tablet having the largest loaded will fracture first, i.e., in the shortest period to time. This loss of strength as a function of the amount of moisture absorbed, explains the need to minimize the magnitude of the load on the tablet in order to extend the time that the device can operate in a high humidity environment without a false activation.

It is thus necessary to develop an apparatus which can significantly reduce the force acting on the tablet while in the armed state, if one is to extend the operating life of the automatic inflation device in the presence of high humidity.

Accordingly, as set forth above, a major disadvantage of the known inflators is premature activation in non-emergency situations. The problem of unintentional activation is so acute that it is not uncommon to have to replace the destructible element on a regular basis when the inflator is stored in high moisture conditions, such as with a life jacket on a boat. Moreover, the problem of prematurely and unintentionally activated automatic inflators is so acute that it is not uncommon to be readily replacing the water destructible elements and resetting the automatic inflators on a regular basis when the inflators are constantly stored around water. It is noted that each of the prior art water activated automatic inflators disclosed in the above referenced patents describe a procedure by which the automatic inflator can be disassembled to facilitate the replacement of the water destructible element and gas-containing capsule so that the inflator may be reused.

Particularly with regard to entirely mechanical inflators, reasons for unintentional activation include insufficiently protecting the destructible element from conditions that cause it to degrade and excessive forces generated by the potential energy stored within the inflator applied directly to the destructible element.

In the patent arts, there have been numerous patents that disclose various types of automatic inflation devices For example, water activated automatic inflators have been disclosed in prior patents whereby a water activated trigger assembly is featured which includes a water destructible or dissolvable element which retains a spring-loaded actuator pin in a cocked position in alignment with a piercing pin. In these devices, upon exposure to water which causes the element to destruct or dissolve, the spring loaded actuator pin is released to forcibly move from the cocked position to an actuated position to strike the piercing pin, either directly or indirectly by means of an intermediate transfer pin. The piercing pin will thus fracture the seal of the cartridge thereby allowing the gas contained therein to flow into the inflatable device in order to inflate it. Representative patents which feature such automatic actuators for inflators having water dissolvable elements include U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, and 5,076,468, and all of the disclosures of these patents are hereby incorporated by reference herein. However, none of these patents features systems which provide added protection against the unintended degradation of the dissolvable element and the unwanted firing of the inflation device.

Still other patents in this field include U.S. Pat. Nos. 2,946,484; 3,809,288; 3,815,783; 3,934,292; 4,191,310; 4,500,014; 4,356,936; 5,816,878; 5,419,725; 5,582,494; 6,561,863; 6,589,087; 5,694,986; 5,601,124; 5,775,358; 5,035,345; 4,972,971; 6,659,824; and 6,394,867; U.S. Pat. App. Pub. Nos. 2004/0124209; 2003/0049982; and 2003/0049981; and European Patent Application No. 598,601, all of said patent references being incorporated herein by reference.

Therefore, what is needed is a device that, among other advantages, will significantly reduce the forces applied thereto, thereby extending the operating life of the automatic inflation device in the presence of high moisture.

SUMMARY OF THE INVENTION

It is thus an object of the present invention to provide an automatic inflation device which provides a means for significantly reducing the force acting on the tablet and thereby extending the operating life of the automatic inflation device in the presence of high humidity.

It is thus another object of the present invention to provide an automatic inflation device which can be manufactured efficiently at lower cost with a reduced number of components and which can have a reduced physical size compared to other devices on the market.

It is further an object of the present invention to provide an automatic inflation device which provides a means for significantly extending the life of an automatic inflation device when exposed to a high humidity environment.

It is still further an object of the present invention to provide an automatic inflation device which has a non-obstructed path for the entrance of water when submerged, yet which is still protected from erroneous triggering.

It is yet another object of the present invention to provide a trigger and release mechanism which can be used in an automatic inflation device which has a reduced force acting on the dissolvable element and which prevents against unwanted triggering of the mechanism.

These and other objects of the present invention are provided by an automatic inflation device which uses a compressed gas cylinder in a housing assembly which includes a puncture pin, cap and manifold for the discharging of a compressed gas in communication with the housings internal cavity; and a spring configured to drive the cylinder so as to engage the pin and discharge the compressed gas, and an activation subassembly consisting of a means to hold the spring in an armed static condition. The system remains in an active/ready status as long as the triggering device remains in the armed condition.

In particular, the automatic inflation device of the present invention features a trigger and release system which comprises a housing, including a manifold for the discharging of a fluid in communication with a subassembly receiving cavity; a puncture pin in communication with the cavity; a pressurized canister subassembly positioned at least partially within the cavity, comprising a pressurized canister holding the fluid (e.g., $CO_2$ gas) and a spring configured to drive the canister so that it engages the pin and discharges at least some of the fluid; and an activation subassembly comprising a flexible restraining element connected to the triggering device, the flexible element configured so as to hold the spring in an armed-static condition as long as said destructible element remains sufficiently intact.

In the particularly preferred embodiment in accordance with the invention, the triggering portion of the device will comprise a degradable tablet positioned within an internal cavity; a male housing including a closed end and a distal open end defining the internal cavity; and a female housing including a closed end and a distal open for receiving the male housing, wherein the housings are releasably coupled; and a holding means attached to each of the closed ends of the male and female housings and configured to hold the compressed gas cylinder subassembly in an armed static condition.

The present invention overcomes the deficiencies of the known prior art devices by 1) greatly reducing the magnitude of the force acting on the tablet, 2) loading the tablet in compression as opposed to shear, 3) utilizing a tablet that has the geometric shape of a disk, torus, sphere or cylinder, and 4) applying the compressive force in the tablets radial direction and thereby utilizing the inherent structural strength of these shapes.

Generally speaking, the triggering and releasing system illustrated herein as an automatic inflation device, utilizes a compressed coil spring to provide the energy to puncture the seal on a commercial pressurized cylinder, here embodied to contain $CO_2$. In the preferred embodiment, the spring is concentric, encompasses the cylinder, and is held in compression between a cap and a base plate by two restraining arms.

The cylinder has a threaded neck that is used to attach it to the mating threads of the cap. The cap has two cutouts in the circumferential wall, located 180 deg apart. These cutouts provide the distal ends of the restraining arms with a surface to engage the cap. The surface of the contact area in the cap's cutouts are oriented at a slight angle. A force vector normal to this surface will create a moment about the restraining arms pivot axis. The direction of the moment created by this force will rotate the arms away from the cap following activation of the triggering device.

When the system is armed, the spring is held in a compressed state. A flexible restraining element, which can be a wire, is used to circumscribe both restraining arms thereby holding them in the orientation that has the distal ends of the arms located inside the cutouts. The wire is a flexible element and will only support a tensile load. This is the state that the wire is in when the system is armed.

Connected to the restraining wire is the triggering device which contains the moisture degradable tablet. For the system to remain in the armed state, the triggering device must sustain the tensile force in the wire without separating.

The triggering device preferably comprises three parts: a degradable tablet, a male housing, and a female housing. The male housing has multiple legs. An internal pocket is formed by those legs, into which the tablet is located. The outside surface of the male housing has a conical shape. This conical surface mates with the inside conical surface of the female housing. The open end of the female housing has a lip that has multiple notches. To assemble the triggering device the male housing legs enter through these notches. The male housing is then rotated so that the legs are no longer aligned with the notches. The presence of the degradable tablet in the internal cavity of the male housing prevents the legs from bending inward. If the legs were allowed to bend inward the two housings would separate.

To trigger the device, the degradable tablet must lose its structural integrity, which then allows the legs of the male housing to collapse, separating the triggering device and thereby releasing the restraining arms and spring. The $CO_2$ cylinder would then be punctured, and its escaping gas used to inflate the inflatable device.

In the preferred device in accordance with the invention, the arming mechanism including the restraining arms and the triggering device are configured so as to greatly reduce the force required to hold the compression spring (normally about 90 lbs force) to only roughly 2-4 lbs. By taking steps such as arranging the location of the restraining arms pivot axis, the length of the restraining arms, the small angle of slope (e.g., about 2 degrees) on the surface of the cap that mates with the distal arm on the restraining arm, the length of the arm at the distal end of the restraining arm and the position along the length of the restraining arm where the wire from the triggering device holds the restraining arm in place to maintain the spring in compression, a great reduction in the force on the dissolvable tablet is achieved, and thus the present invention avoids the problems of prior art triggering devices which maintain the normal 90 lbs of spring force acting on the tablet, and which thus are extremely prone to accidental triggering when the tablet absorbs even small amounts of moisture from high humidity conditions.

The preferred device also provides a unique triggering device as described above which is designed to have a restraining arms containment wire, male and female housing, and the dissolvable tablet which is held in an internal cavity of the male housing. In accordance with the invention, the design of the triggering device including the make and female housing will subject the tablet to radial compressive forces, and thus the preferred form of the tablet is a torus or disk loaded radially in compression, and this is inherently very strong, much in the way that an eggshell is designed to resist forces. There are other suitable shapes for the tablet of the invention, including spherical, square, etc., and these will also be designed to make the tablet less prone to undesired triggering. Most of the prior devices discussed above load their tablets in shear and thus do not further ensure safeguards to restrict accidental triggering as does the device of the present invention. The features of the present invention are thus important because there is no way to stop the triggering tablet from absorbing moisture which will be accompanied by a loss of strength and thus the only way to extend the time before an erroneous trigger is activated is by decreasing the force on the tablet in accordance with the present invention. The present invention can also be made compact and thus be smaller in size than existing units.

While the foregoing has outlined features of the present invention, these and other features of the present invention as set forth in, or will become obvious from, the detailed description of the preferred embodiments provided hereinbelow which further describes the contribution of the present invention to the art.

BRIEF DESCRIPTION OF THE DRAWING FIGURES

Figure 2:
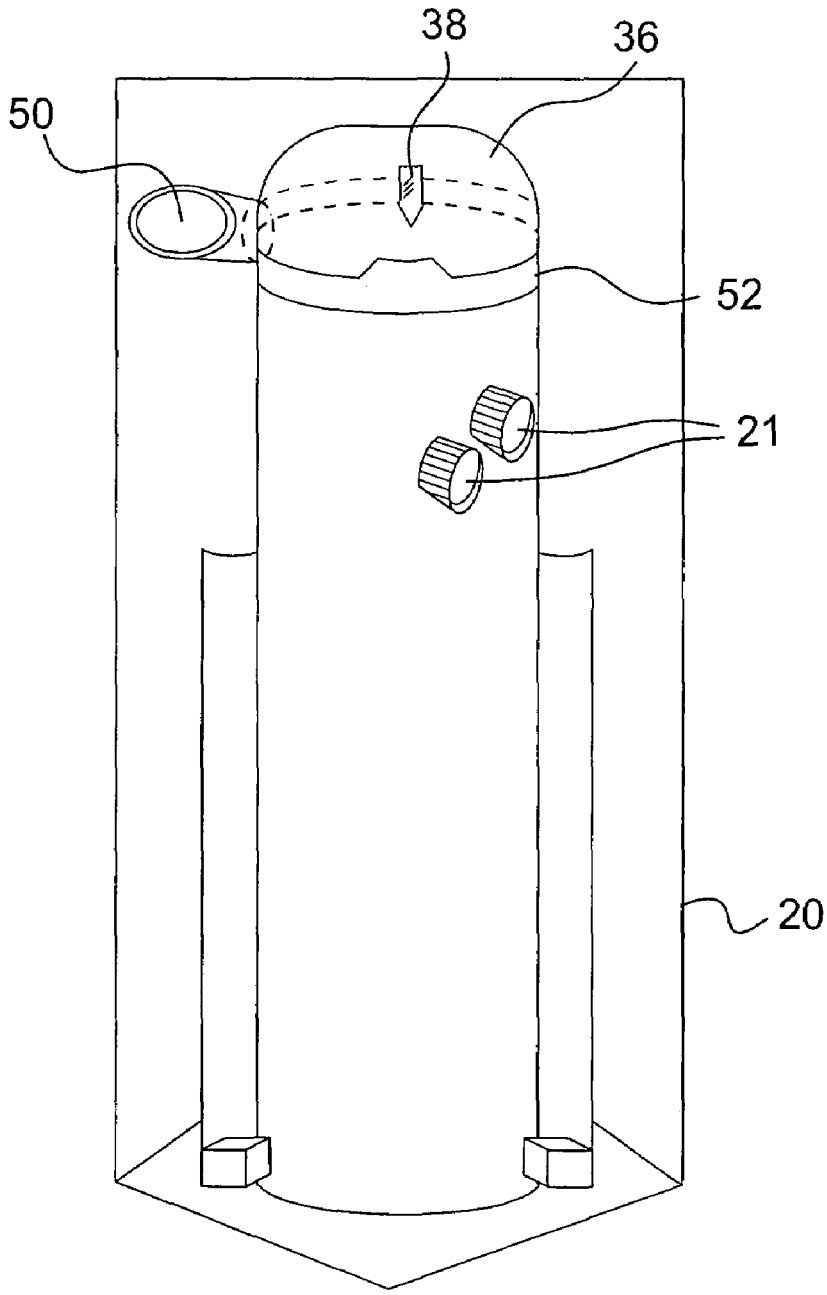
FIG. 2 illustrates a sectioned isometric view of the housing subassembly of the automatic inflation device of the present invention.
Figure 2A:
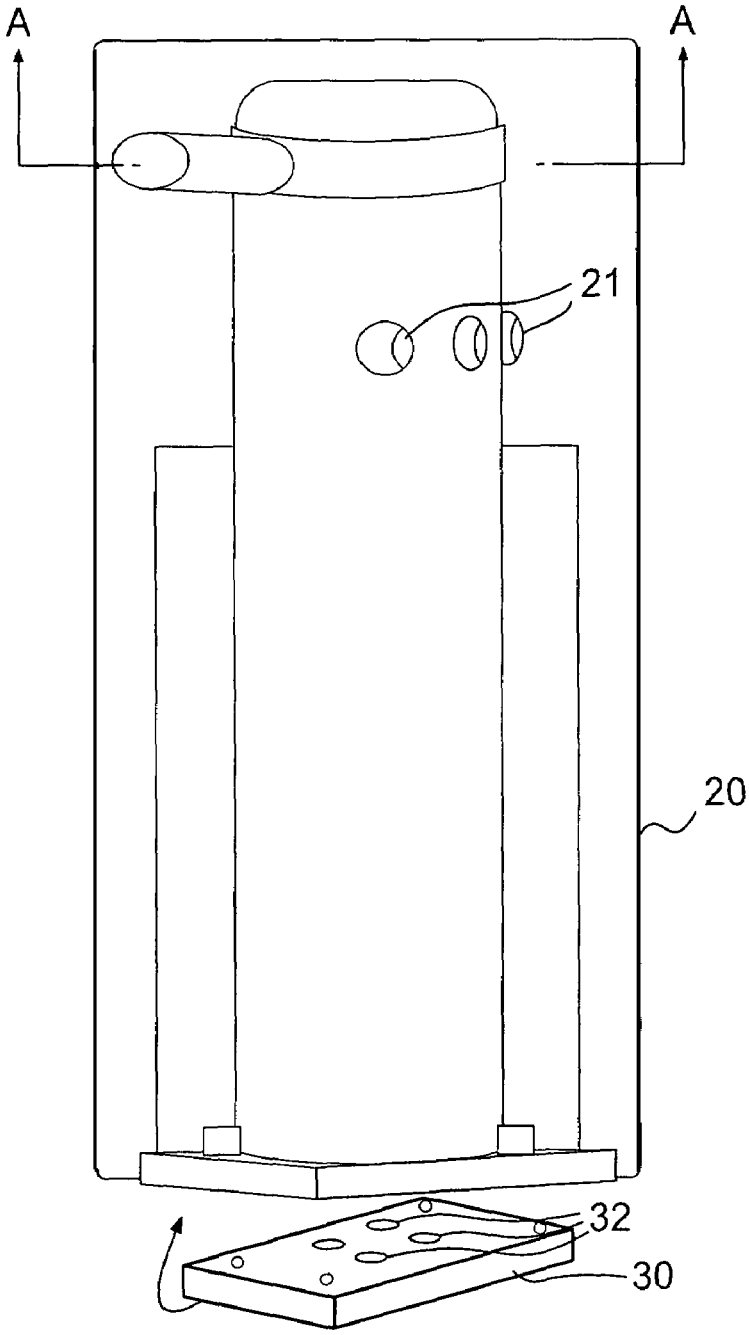

FIG. 2*a* illustrates a sectioned isometric view showing additional features of the automatic inflation device of the present invention.

Figure 2B:
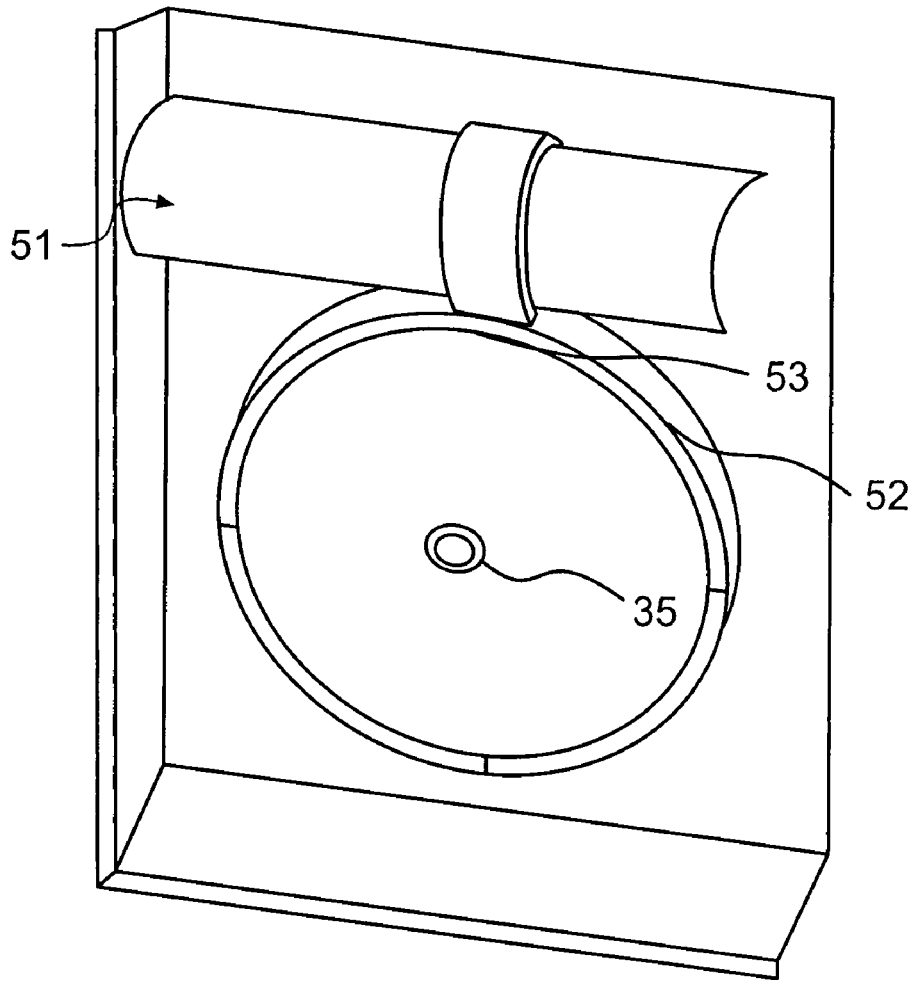

FIG. 2*b* is a sectional view taken along line A-A in FIG. 2*a*.

Figure 2C:
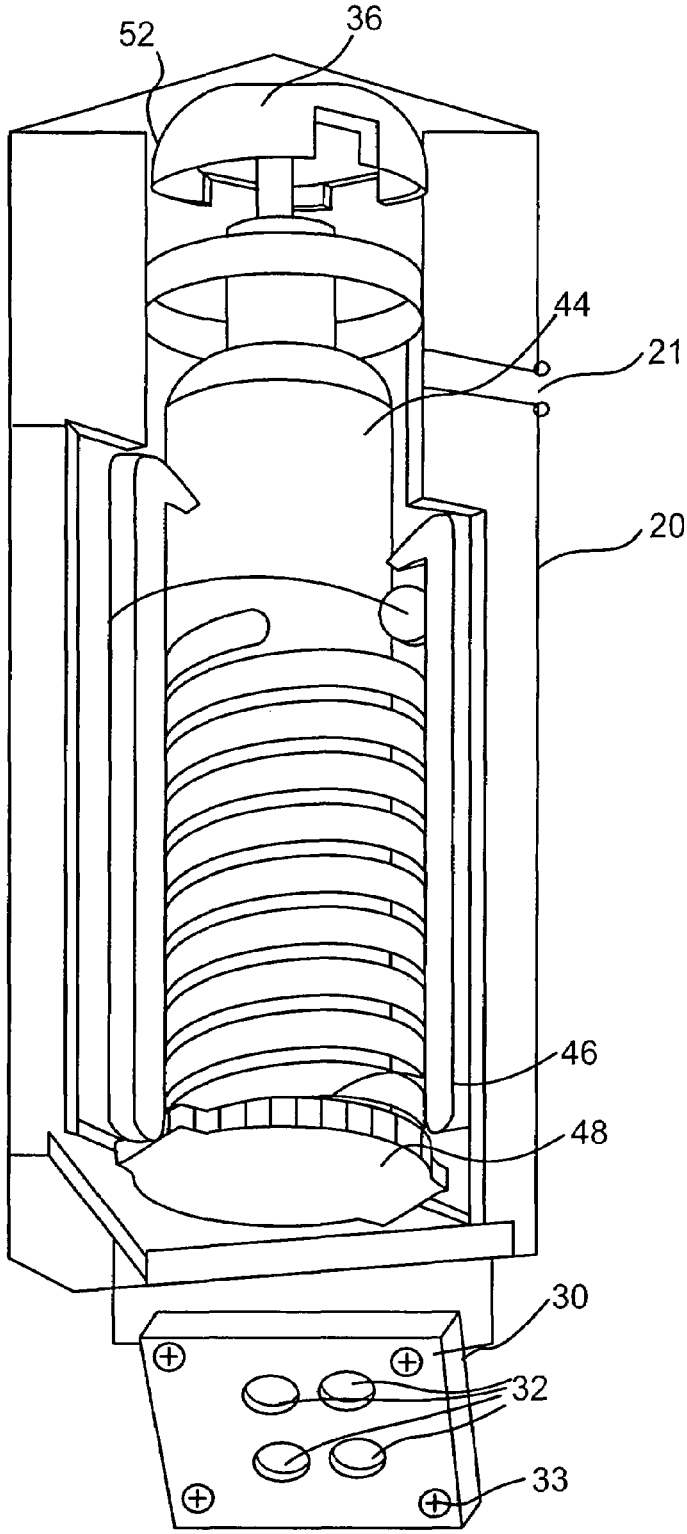

FIG. 2*c* is a front cut-away view of the cylinder subassembly and spring of the device of the present invention.

Figure 2D:
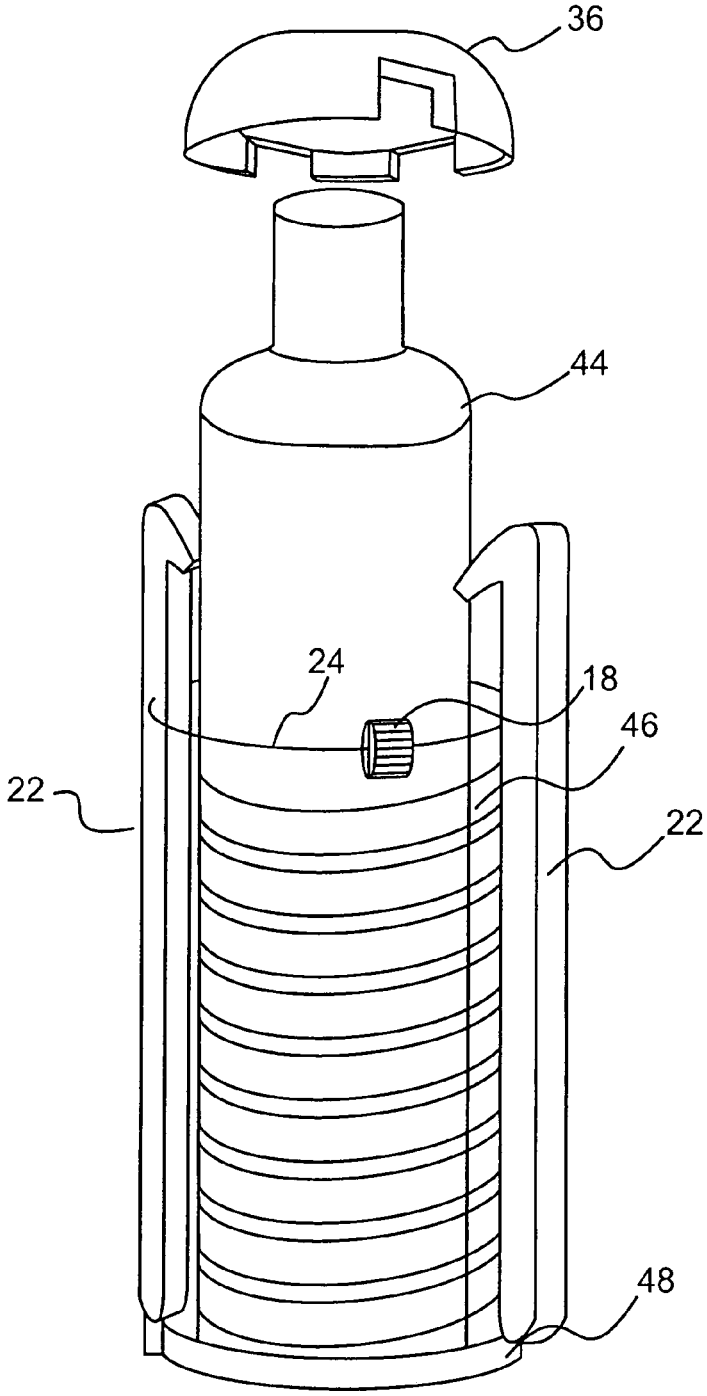

FIG. 2*d* is a front exploded view of the cylinder subassembly and spring of the device of the present invention.

Figure 3:
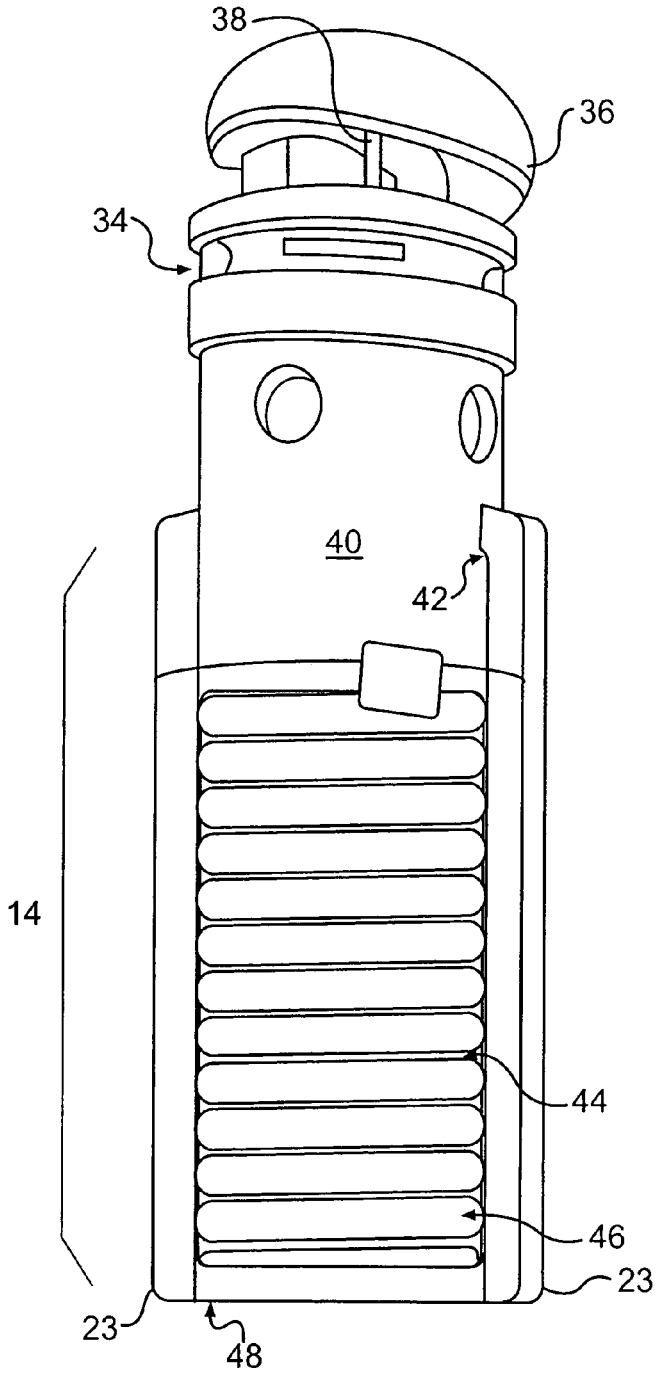

FIG. 3 illustrates a cylinder subassembly in accordance with an exemplary embodiment of the present invention.

Figure 3A:
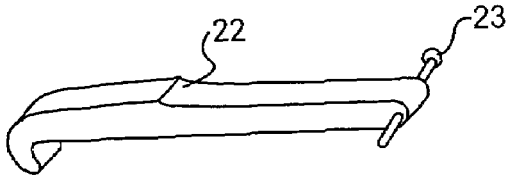
Figure 3B:
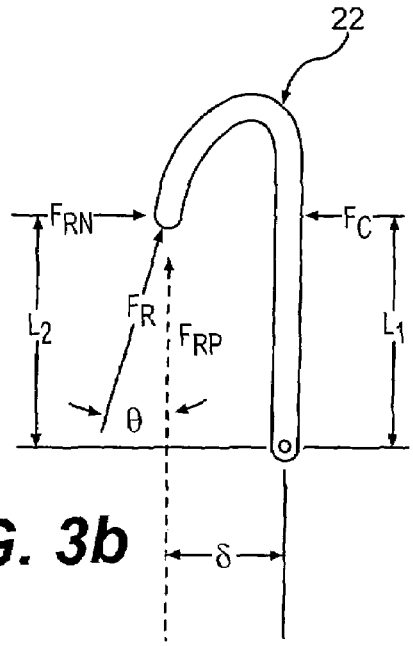

FIG. 3*a* is a perspective view of a restraining arm in accordance with the present invention FIG. 3*b* is a free body diagram of the restraining arm or wire along with the statics equations that define the force $F_C$ in accordance with an exemplary embodiment of the present invention.

Figure 3C:
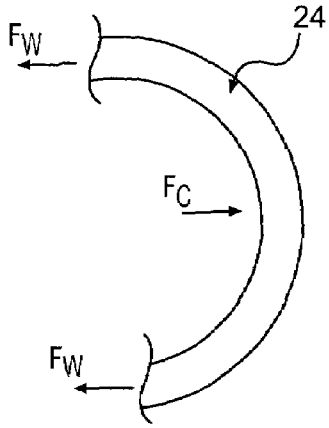

FIG. 3*c* is a free body diagram of the restraining arm or wire along with the statics equations that define the force $F_W$ in accordance with an exemplary embodiment of the present invention.

Figure 4:
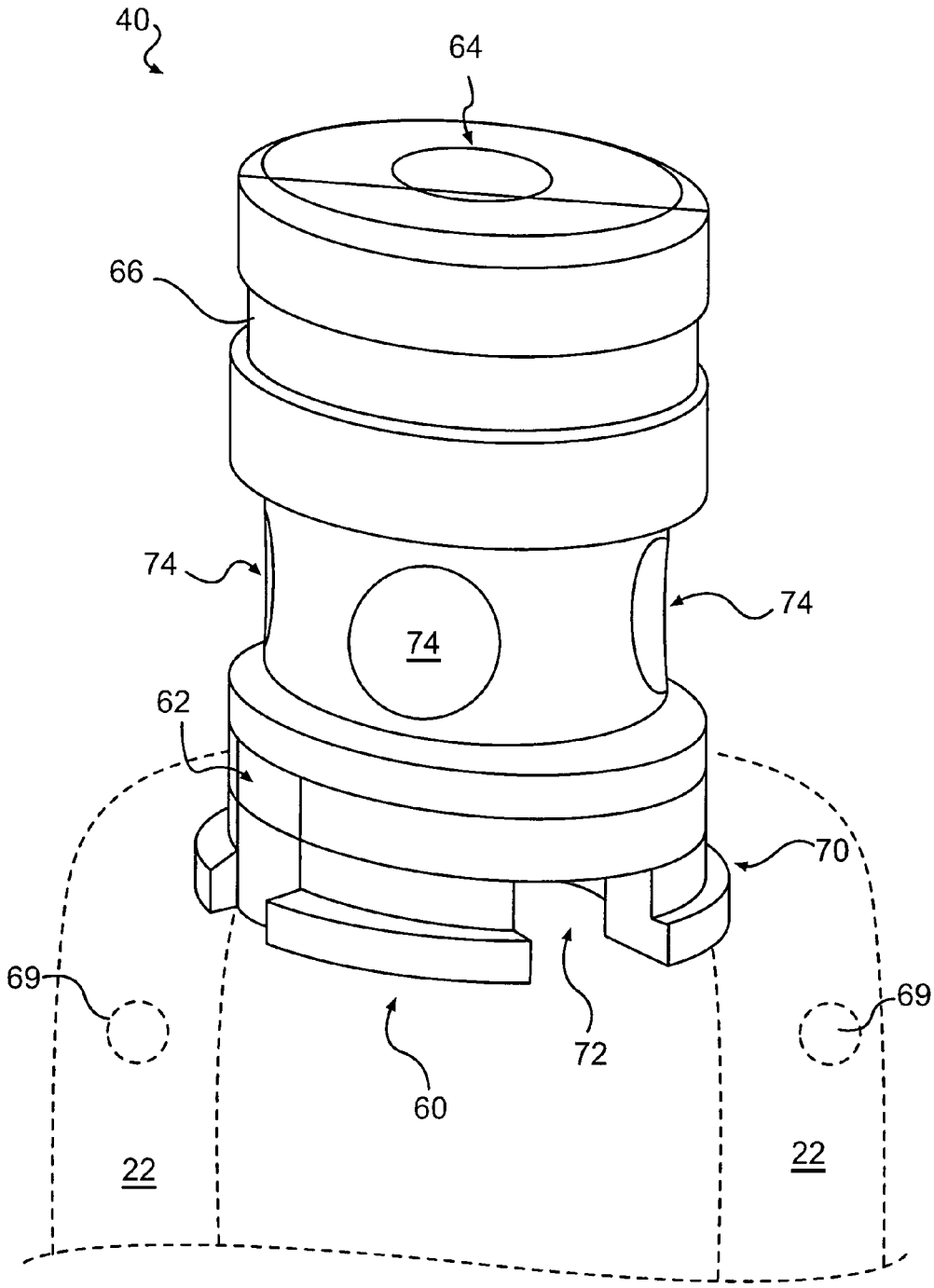

FIG. 4 is an isometric view of a cap in accordance with an exemplary embodiment of the present invention.

Figure 5:
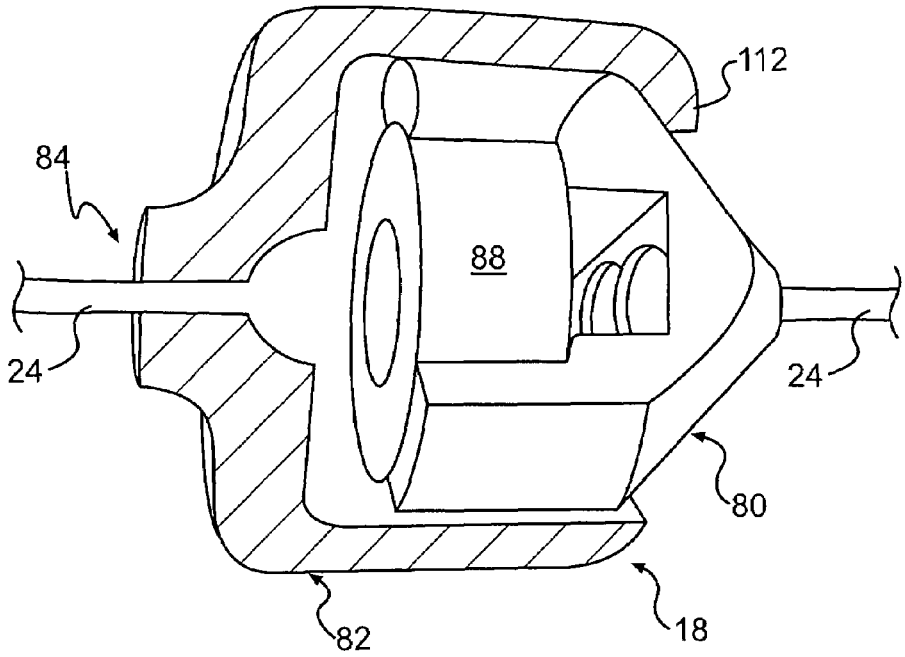

FIG. 5 is a sectional isometric view of a triggering device in accordance with an exemplary embodiment of the present invention.

Figure 5A:
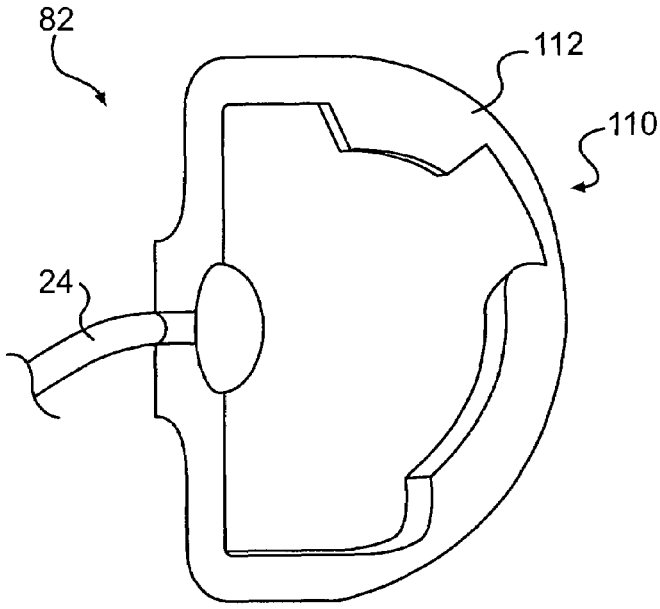

FIG. 5*a* is an isometric view of a female housing in accordance with an exemplary embodiment of the present invention.

Figure 5B:
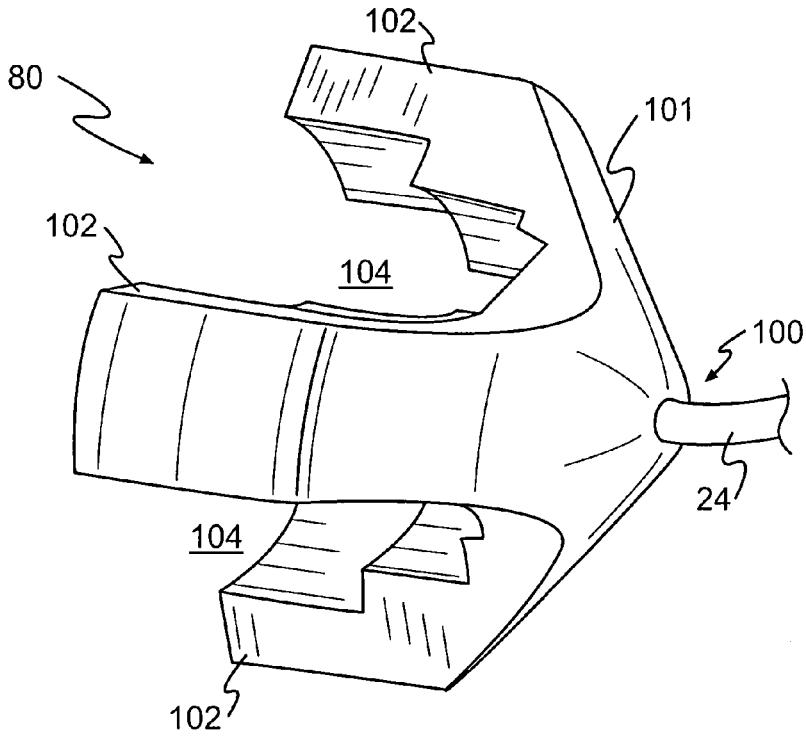

FIG. 5*b* is an isometric view of a male housing in accordance with the exemplary embodiment of the present invention.

Figure 6:
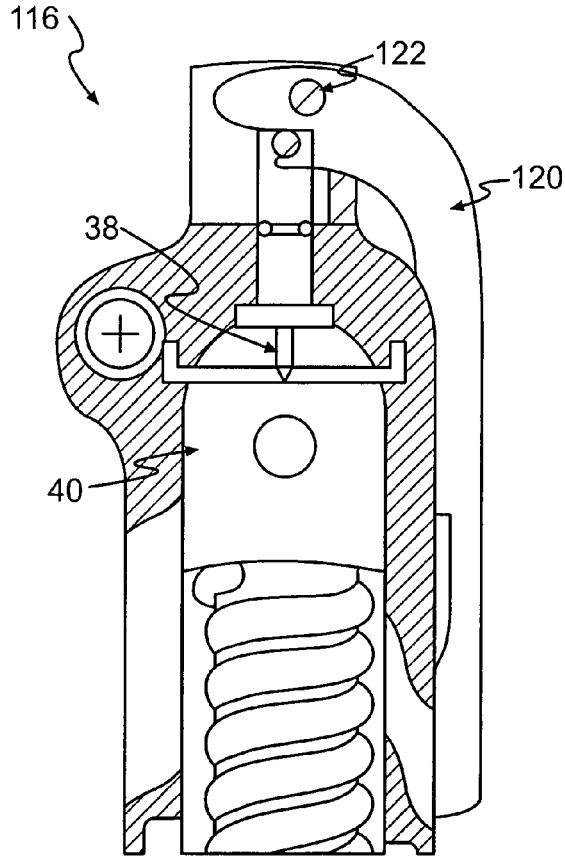

FIG. 6 is a cross-sectional view of an alternative embodiment of an automatic inflation device in accordance with the present invention.

DETAILED DESCRIPTION OF THE INVENTION

In accordance with the present invention, an automatic inflation device is provided which in general comprises a housing assembly having a puncture pin, cap and manifold for the discharge of compressed gas in communication with the cap, a compressed gas cylinder subassembly positioned at least partially within said cavity, comprising a compressed gas cylinder, and a spring configured to drive said cylinder to engage said pin and discharge at least some of said compressed gas. In addition, the inflation device preferably includes an activation subassembly comprising a holding means connected to both ends of a triggering device subassembly, said holding means configured so as to hold said spring in an armed static condition as long as said triggering device subassembly remains in the armed condition and so as to reduce the force acting on a degradable element which is positioned within the trigger housing which provides structural integrity so as maintain the triggering device subassembly in armed condition so long as said element is not degraded.

In addition, in accordance with the present invention, a trigger and release system suitable for use in an automatic inflation device is provided which generally comprises a housing, including a manifold for the discharging of a fluid substance in communication with a subassembly receiving cavity; a puncture pin in communication with said cavity; a pressurized canister subassembly positioned at least partially within said cavity, comprising a pressurized canister holding said fluid substance and a spring configured to drive said canister to engage said pin and discharge at least some of said fluid substance; and an activation subassembly comprising a flexible restraining element connected to a trigger device, said flexible element configured to hold said spring in an armed-static condition as long as said destructible element remains sufficiently intact. Once again, the system is designed so that the force is reduced on the destructible or degradable element, and this allows for a triggering mechanism which will be far less likely to be activated until desired, and will allow for a longer lifetime for inflation devices incorporated this feature of the present invention.

Generally speaking the systems and methods described herein are directed to a trigger and release system. As required, embodiments of the present invention are disclosed herein; however, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

For purposes of teaching and not limitation, the preferred embodiments are illustrated in the drawings figures and described in detail below, and these embodiments are generally directed to filling inflatable devices with $CO_2$ escaping from a punctured $CO_2$ container. More particularly, the illustrated embodiments describe the trigger and release system of the present invention in the form of an automatic inflation device that includes a body, o-ring seal, cap, $CO_2$ cylinder, a spring, restraining arms, puncture pin, and an activation assembly.

Figure 1:
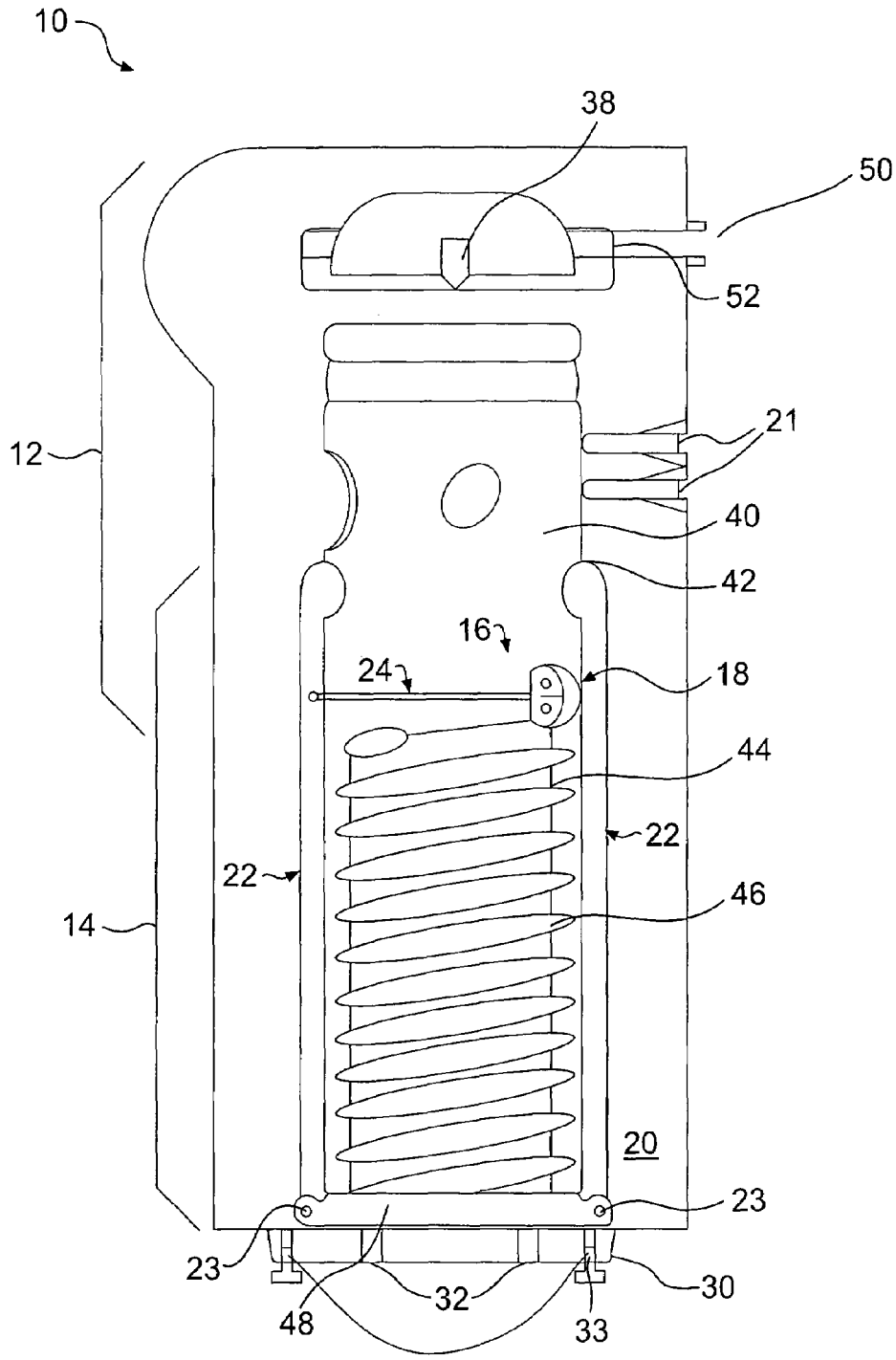
FIG. 1 illustrates an automatic inflation device in accordance with an exemplary embodiment of the present invention.

Referring now to the drawings wherein like elements are represented by like numerals, FIG. 1 illustrates the automatic inflation device 10, which includes a housing subassembly 12, a $CO_2$ cylinder subassembly 14, and a activation subassembly 16. As also shown in FIG. 1, and as described further below, the cylinder assembly includes restraining arms 22 on either side of the $CO_2$ cylinder 44 within coiled spring 46. The restraining arms 22 are preferably configured to be pivotable, preferably through the use of pivot pin 23 which connects each restraining arm 22 to a cylinder base plate 48. Below the cylinder base plate 48 is a housing base plate 30 having perforations 32, and base plate 30 may be secured using any conventional means, e.g., bolts, screws, etc. As shown in the sectioned isometric view of the housing subassembly 12 seen in FIGS. 1, 2 and 2*a*, the housing subassembly includes the body 20, the puncture pin 38 and the perforated housing base plate 30 with holes 32, which provides the structural resistance to the force of the spring 46 when it is released and a passage way for water to get to the trigger element when the inflation device is submerged in water.

The body 20, is a molded plastic component, possibly opaque or transparent, slightly longer than the $CO_2$ cylinder and slightly larger in circumference. A cylindrical cavity is located with its longitudinal axis aligned with the longitudinal axis of the body. One end of the cylindrical cavity is closed, having a hemispherically shaped end. A cylindrical pocket/hole is located at the center of the hemisphere and aligned with the centerline of the cylindrical cavity to accommodate the puncture pin 38. The radius of the hemisphere is slightly less than the radius of the cylindrical cavity. This difference in radiuses provides a mechanical stop for the end of the cap 40 when it is being thrust forward by the coil spring. Multiple slots are molded into the hemispherical end to provide an exit path for the released $CO_2$ to the circumferential manifold located adjacent to the dome and connecting to a exit port. In addition, there are water passage holes 21 in the body 20, and these holes, together with the holes in the base plate 30, form the passage way for the water to enter and exit the internal cavity of the body where the trigger device is located.

FIG. 3 shows the $CO_2$ cylinder subassembly 14 that includes a $CO_2$ cylinder 44 encircled by a coil spring 46 and supported by the $CO_2$ base plate 48. The $CO_2$ base plate 48 supports the $CO_2$ cylinder 44 and the coil spring 46. In addition it also provides the attachment point for the two restraining arms 22. The spring 46 is initially compressed by the pressing downward of the cap 40. This pressure compresses the spring 46 to a length that will accommodate the positioning of the distal end 42 of the restraining arm 22 into the cap 40. Additional views of the internal workings of the device in accordance with the present invention are shown in FIGS. 2*c* and 2*d*.

In the preferred embodiments as shown in the drawing figures, a $CO_2$ cylinder puncture pin 38 is located at the center of the closed end of the cylindrical cavity and is concentric with the bore in the body 20. The puncture pin is retained inside crown 36 which is a molded plastic piece which may be separate or may be molded into the body 20 and thus not be a separate piece. The puncture pin 38 consists of a small diameter shaft with a sharpened point which permits the release of the compressed $CO_2$ following penetration of the $CO_2$ cylinders friable seal. The upper region of the pin 38 sits in a pocket/hole in the closed end of the cylindrical cavity which is in communication with a circumferential manifold 52 which directs the $CO_2$ gas to escape through $CO_2$ passage 51 through at least one opening 50, best illustrated in FIG. 1. When pin 38 punctures the $CO_2$ cylinder 44 as a result of the cylinder being thrust forward by the extending spring 46, the escaping gas exits through circumferential manifold 52 and through radial $CO_2$ exit passage 51 and opening 50 to exit the body 20. This is particularly shown in FIGS. 2*a* and 2*b* wherein the body 20 is shown including crown 36 and $CO_2$ opening 50 in FIG. 2*a*, and a sectional view along Line A-A of FIG. 2*a*is shown in FIG. 2*b*. As observed in FIG. 2*b*, the circumferential manifold 52 surrounds a hole 35 for the puncture pin, and this includes manifold opening 53 which directs $CO_2$ gas through $CO_2$ passage 51 and ultimately out through opening 50.

As will be understood by one skilled in the art, the body 20 may be connected or mated to a device intended to receive the gas released from the pressurized canister, here illustrated as a $CO_2$ cartridge, such that the escaping gas is directed from the manifold 52 through opening 50 to the receiving portion of the connected device. It will further be understood that the escaping gas may alternatively be directed immediately to the atmosphere, as that serves the purpose of alternative embodiments contemplated including emergency signaling devices releasing colored inert gases.

Accordingly, as will also be understood, pressurized canisters include any container holding a fluid—in gas, liquid, or a combined form—constructed of any material, wherein the fluid is to be released from the container at some time based on one or more events.

The $CO_2$ cylinder subassembly 14 also includes the cap 40, which is best shown in FIG. 4. Here the cap 40 is preferably a molded plastic component that has an internal cavity 60 with a centrally located threaded hole 64 that matches the threads on the neck of the $CO_2$ cylinder 44. An o-ring groove 66 on the outside surface of the cap 40 receives the o-ring seal 34. The restraining arm contact cutouts 62 on which the distal ends of the restraining arms 42 engage the cap 40 are outwardly inclined. A vector normal to the inclined surface will be directed away from the cap's centerline.

The restraining arm contact cutouts 62, located in the cylindrical wall of the cap 40, accommodate the distal ends of the restraining arms 42. The restraining arms 22 traverse the outer surface of the $CO_2$ cylinder subassembly 14 to connect at the $CO_2$ cylinders base plate 48. The activation subassembly 16, best shown in FIG. 1, is threaded through the restraining aperture 69 just above the point where the cap 40 ends and positioned to rest on flange 70, located at the bottom of the cap 40. Alternatively, it can circumscribe the restraining arms if so desired.

The trigger receiving aperture 72 located within the flange 70 provides a recess that aligns the wires attached to the trigger housing to with the groove in the flange 70 serving the purpose of locating and securing the wire.24 as it holds the restraining arms 22. Four traverse holes 74 provide for the passage of water that enters the body 20 from either the perforations in the base plate 48 or the vent holes in the body.

The activation subassembly 16 comprises two parts: the triggering device 18 and a wire 24 that is connected to both closed ends of the triggering device 18. FIG. 5 shows a cross-section view of the triggering device 18. As shown, it includes three parts: the male housing 80, the female housing 82, and the water-soluble tablet 88. The shape of the tablet 88 can be of any suitable shape, such as disks, spheres, ellipsoids, square, etc., and it can be solid or hollow.

With reference to FIGS. 5, 5*a*, and 5*b*, the female housing 82 has a diameter slightly larger than that of the male housing 80. The closed end 84 of the female housing 82 is attached to the wire 24. The open end of the female housing 82 has a lip 112, which has an internal diameter that is smaller than the outside diameter of the male housing 80. Located in the lip 112 are multiple notches 110 that are of a size and location that permit the male housing 80, when its legs 102 are clocked with the notches 110, to fit inside the female housing 82.

The illustrated male housing 80, FIG. 5*b*, has multiple legs 102. The legs are designed to have a segment having a very small cross section which acts as a hinge. Here, the legs 102 cannot support a bending moment. An internal pocket 104, formed by the legs 102, is where the tablet 88 is positioned. The outside surface of the male housing 80 has an external conical surface that mates with the interior conical surface of the female housing 82.

Once inside the female housing 82, the male housing 80 is rotated so that its conical surface 100 is matingly secured to the inside conical surface of the female housing 82. The water-soluble tablet 88 in the internal pocket 104 of the male housing 80 prevents the legs 102 from bending inward. Between the conical surface 100 and the far end of legs 102 will be a hinge point 101 which will allow the legs to bend when necessary to trigger the device. When the legs 102 are allowed to bend inward, the effective outside diameter of the male housing 80 becomes less than the inside diameter of the female housing 82, and the tensile force in the wire 24 causes the male 80 and female housing 82 to separate. The action of the tablet 88 being exposed to water, is to immediately lose its structural integrity, causes the male 80 and female housing 82 to separate, beginning the sequence of releasing.

When the tablet 88 loses its structural integrity, its ability to resist a compressive force approaches zero, and the legs 102 of the male housing 80 fold inward allowing the two halves of the triggering device 18 to separate. This separation action eliminates the containment of the restraining arms 22. The moment created by the force of the compressed spring 46 acting on the restraining arms 22 forces the arms 22 out of the cap 40. The cap 40 and the $CO_2$ cylinder 44 are then driven forward impacting the seal of the $CO_2$ on the puncture pin 38, thereby releasing the compressed $CO_2$.

The following describes the operation of the triggering and releasing sequences in terms of the internal forces involved. FIG. 3 illustrates the cylinder subassembly 14 in the armed-static condition. As will be understood by one skilled in the art, a force $F_S$ is developed by the spring 46 when held in the compressed state shown in FIG. 3. The force $F_S$ acts on both the $CO_2$ cylinder base plate 48 and the cap 40, A second force $F_R$ is also acting on the cap. It is the result of the restraining arms 22 in conjunction with the restraining wire 24 holding the cap equilibrium. A view of one of the restraining arms 22 is shown in FIG. 3*a* which indicates that a pivot pin 23 is preferably employed at the connection between the restraining arm and the cylinder base plate 48. The direction of the force $F_R$ is normal to the sloped surface of the cutout 62.

As described herein, the outwardly sloped bottom surface of each cutout 62 engages the distal end of a respective restraining arm 22. The $F_R$ which has a direction normal to the sloped surface of the cutout 62, can be resolved into components, $F_{RP}$ and $F_{RN}$ that are parallel and normal to the longitudinal axis of the body, respectively. In this embodiment the effect of the moment created by the force $F_R$ acting about the restraint arms 22 pivot axis is to rotate the arms 22 outwardly to begin the activation sequence when the arms 22 are no longer restrained by the restraining wire 24. FIG. 3*b* is a free body diagram of the restraining arm 22 along with the statics equations that define the force $F_C$.

To hold the arms 22 in the cutouts 62, the restraining wire 24 is threaded through restraining apertures 69 and joined together. The wire 24 could also fit in a notch in the outer surface of the arms-circumscribe. In the preferred armed-static condition the tensile force $F_W$ in the restraining wire 24 is equal to approximately 0.25 $F_S\delta/L$, where L is approximately 15 times larger than δ. FIG. 3*c* is a free body diagram of the restraining wire 24 along with the statics equation that defines the force $F_W$.

Opposite ends of restraining wire 24 connect to the triggering device subassembly 18 at the closed ends of both the male housing 80 and female housing 82. Thus each housing 80, 82 is subject to a tensile force of $F_W$.

Each housing 80, 82 of the illustrated embodiment includes a conical or cylindrical slope. The force $F_W$ is applied uniformly to the matingly engaged edge in a radial direction. The inherent structural strength of the cylindrical sections provides the rigidity to maintain each housing in its initial slope.

With reference now to FIGS. 5, 5*a* and 5*b*, the force $F_T$ exerted by the legs 102 on the tablet 88, is a radial compressive load that, in the armed-static condition, is less than $F_W$ but not zero. Also, in the armed-static condition, the tablet 88 provides sufficient structural integrity to resist the force $F_T$. Without the tablet 88 or when the tablet 88 loses its structural integrity, the resistive force approaches zero, and the legs 102 of the male housing 80 fold inward.

The folding or collapsing of the legs 102 permit the two housings 80, 82 to separate. In separating, the forces $F_W$ and $F_R$ reach zero, thereby eliminating the resistive force on the restraining arms 22. In other words, upon the legs collapsing the restraining wire 24 becomes limp and the restraining arms 22 are forced out of the cutouts 62. With the spring 46 no longer constrained, it extends to drive the cap 40 with connected cylinder 44 forward, puncturing the friable seal of the cylinder 44 on the puncture pin 38 and releasing the compressed gases.

With regard to the assembly of the present invention and the placing of the illustrated embodiments in the armed-static condition, the following is an illustrative sequence. In the preferred mode, the $CO_2$ cylinder 44 is threaded into the cap 40. Then the coil spring 46 is placed over the $CO_2$ cylinder 44. Next the $CO_2$ cylinder 44 and its coil spring 46 are placed on the $CO_2$ base plate 48. The restraining arms 22 are then attached to the $CO_2$ base plate 48 via a pivot axis pin NN. The cap 40 is then pressed down, compressing the spring 46 to a length that will accommodate the positioning of the distal ends of the restraining arms 42, via rotation about their pivot axis, into their respective cutouts 62 in the cap 40.

Next, the triggering device 18 is preferably assembled by placing the tablet 88 in the male housing 80. The male housing 80 is then placed inside the female housing 82. The male housing 80 is locked into place by its rotation.

With the soluble tablet 88 inside the housings 80, 82 of the assembled triggering device 18, the attached wire 24 is then positioned in the cutout 72 of the cap 40 and drawn to circumscribe the two restraining arms 22. The two ends of the wire 24 are then joined making the activation subassembly 16. The restraining arms 22 are now holding the spring 46 in compression and the $CO_2$ subassembly 14 can be inserted into the cylindrical cavity of the body 20. Final step is assembling the body base plate 30 in its recess in the body 20 and securing it in places with screws or adhesive. The body base plate 30 can be seen, e.g., in. FIG. 2*c*, and in the preferred mode, it will have screw holes 33 so as to be attachable to the body 20 and will also contain holes or perforations 32 which will allow the passage of water into the device.

An alternative embodiment 116 of the housing subassembly 12, shown in FIG. 6, includes a manual activation arm 120. The manual activation arm 120 is attached to the housing subassembly 12 with a pin 122. The pin 122 serves as the lever axis of rotation when the manual activation arm 120 is being used to manually activate the automatic inflation device 10. The manual activation arm 120 is being used to manually activate the automatic inflation device 10. The manual activation arm 120 is designed to capture the puncture pin 38 that is the housing subassembly 12. The handle or straight section of the manual activation arm 120 can be held in its armed position using either a containment wire or detents in the housing.

To manually activate the automatic inflation device 10, force is applied to the handle of the manual activation arm 120, which either breaks the wire or causes the arm 120 to be pulled out of its detents. The rotation of the manual activation arm 120 provides the motion and force that drives the puncture pin 38 into the $CO_2$ cylinder 44.

In a further embodiment of the present invention, it is possible to add a feature so as to color-code the automatic inflation device so as to identify operational status of the triggering mechanism. Such a system is shown, e.g., in U.S. Pat. No. 5,694,986, incorporated herein by reference.

In short, the present invention provides an automatic inflation device and a trigger and release system that is advantageous over prior systems such as those using a dissolvable tablet in the triggering mechanism in that it now provides a means for significantly reducing the force acting on the tablet so as to extend the operating life of the automatic inflation device in the presence of high humidity and to further protect the device against unwanted release of the trigger mechanism. The trigger and release mechanism of the present invention is thus designed to significantly reduce both the magnitude of the load on the dissolvable activator tablet, and the type of load from shear to compression. These two factors are thus particularly advantageous in enabling the automatic inflation device of the present invention or other similar devices utilizing the trigger and release mechanism of the present invention to remain in the armed condition for very long periods of time, even when operated in conditions that would favor the premature activation of such devices, e.g., the presence of high temperatures and high humidity levels.

It is thus submitted that the foregoing embodiments are only illustrative of the claimed invention, and additional alternative embodiments which would be well known or obvious to one skilled in the art based on the above disclosure but not specifically set forth hereinabove also fall within the scope of the claims appended hereto.

What is claimed is:

1. An automatic inflation device, comprising:

a housing having an internal cavity for retaining a cylinder containing a compressed gas and a manifold for the discharging of a compressed gas from the cylinder so as to exit the housing;

a puncture pin attached to said housing and located in said housing internal cavity a compressed gas cylinder subassembly positioned at least partially within said housing internal cavity, comprising a compressed gas cylinder having a cap attached thereto, a base plate, restraining arms attached to the cylinder base plate and a spring held in compression between sad cap and said cylinder base plate, said spring configured to drive said cylinder to engage said puncture pin and discharge at least some of said compressed gas; and a triggering device subassembly positioned within said housing internal cavity and circumferentially encompassing said restraining arms, said triggering device subassembly comprising a degradable element subject to compression forces which provides structural integrity so as maintain the triggering device subassembly in armed condition so long as said element is not degraded; and an activation subassembly comprising a holding means connected to said triggering device subassembly, said holding means configured so as to hold said spring in an armed static condition as long as said triggering device subassembly remains in the armed condition.

2. The device of claim 1, wherein said cap includes a means for engaging said spring and is detachably connected to a first end of said cylinder;

wherein said base plate includes a means for engaging said spring, positioned at the second end of said cylinder;

wherein at least one of said restraining arms is rotatably connected to the base plate at one of its ends and the cap at its other end; and wherein said spring is positioned between the cap and base plate, at least partially compressed, and held by compression by said restraining arms.

3. The device of claim 1, wherein said activation subassembly comprises a flexible restraining element connected to said triggering device, and wherein said activation assembly is configured to hold said spring in an armed-static condition as long as said destructible element remains sufficiently intact.

4. The device of claim 1, wherein said triggering device subassembly comprises:

a male housing including a closed end and a distal open end defining said internal cavity and having therein a degradable element;

a female housing including a closed end and a distal open end for receiving said male housing, wherein said housings are releasably coupled; and, a flexible restraining member attached to each of said respective closed ends and configured to hold the compressed gas cylinder subassembly in an armed-static condition.

5. The device of claim 4, wherein said degradable element provides structural integrity to said male housing as long as said element is not degraded.

6. The device of claim 5, wherein said male housing collapses within said female housing, in response to a loss of structural integrity of said degradable element, causing said housings to uncouple.

7. The device of claim 6, wherein said holding means permits the compressed gas cylinder subassembly to disengage from the armed static condition in response to said uncoupling.

8. A trigger and release system, comprising:

a housing, including a manifold for the discharging of a fluid substance in communication with a subassembly receiving cavity;

a puncture pin in communication with said cavity;

a pressurized canister subassembly positioned at least partially within said cavity, comprising a pressurized canister holding said fluid substance and a spring configured to drive said canister to engage said pin and discharge at least some of said fluid substance; and, an activation subassembly comprising a flexible restraining element connected to a degradable restraining element subject to compression forces, said flexible element configured to hold said spring in an armed-static condition as long as said degradable element remains sufficiently intact, wherein said canister subassembly further comprises:

a first element, including a means for engaging said spring, detachably connected to a first end of said canister;

a second element, including a means for engaging said spring, matingly positioned adjacent a second end of said canister; and, at least one restraining arm rotatably connected to one of said elements and releasably mated to the other said element at a distal end of said arm;

wherein said spring is positioned between said elements, at least partially compressed, and held as compressed by said arm.

9. The system of claim 8, wherein said degradable restraining element further comprises an interior element configured to structurally degrade in response to specific conditions, releasably connected to an exterior housing.

10. The system of claim 9, wherein said interior element further comprises a first degradable element configured to provide structural integrity to an interior housing until there is a degradation of said element and said interior housing, releasably coupled to said exterior housing, is configured to fail and separate from said exterior housing in response to said degradation.

11. The system of claim 8 further comprising a manual activation arm in communication with said pin, configured to drive said pin to engage said canister and release at least some of said fluid substance.

12. A restraining and releasing apparatus usable with a pressurized cylinder comprising:

a male housing including a closed end and a distal open end defining said internal cavity and having therein a degradable element;

a female housing including a closed end and a distal open end for receiving said male housing, wherein said housings are releasably coupled; and, a flexible restraining member attached to each of said respective closed ends and configured to hold a release mechanism by radial compression in an armed-static condition, wherein said degradable element provides structural integrity to said male housing as long as said element is not degraded; and wherein said male housing collapses within said female housing, in response to said loss of structural integrity, causing said housings to uncouple.

13. The apparatus of claim 12, wherein said flexible member permits said release mechanism to disengage from the armed-static condition in response to said uncoupling.

14. The apparatus of claim 12, wherein said male housing has multiple legs.

15. A triggering device comprising:

a degradable tablet positioned within an internal cavity;

a destructible male housing including a closed end and a distal open end defining said internal cavity;

a female housing including a closed end and a distal open for receiving said male housing, wherein said housings are releasably coupled; and, a compressed gas cylinder subassembly positioned at least partially within said cavity, comprising a compressed gas cylinder, a pin, and a spring configured to drive said cylinder to engage said pin and discharge at least some of said compressed gas;

a holding means attached to each of said male and female closed ends and configured to hold the compressed gas cylinder subassembly in an armed static condition while reducing force on the degradable tablet.

16. The device of claim 15, wherein said male housing further comprises a degradable tablet configured to structurally degrade in response to specific conditions, releasably connected to female housing.

17. The device of claim 15, further comprising a manual activation arm in communication with said puncture pin, configured to drive said pin to engage said compressed gas cylinder and release at least some of said compressed gas.

18. The device of claim 15, wherein said degradable tablet provides structural integrity to said male housing.

19. The device of claim 15, wherein said male housing collapses within said female housing, in response to a loss of structural integrity, causing the housings to separate.

20. The device of claim 15, wherein said holding means permits the compressed gas cylinder subassembly to disengage from the armed static condition in response to said uncoupling.

21. An automatic inflation system, comprising:

a housing assembly, including a puncture pin, cap and manifold for the discharging of a compresses gas in communication with the cap internal cavity, a compressed gas cylinder subassembly positioned at least partially within said cavity, comprising a compressed gas cylinder, and a spring configured to drive said cylinder to engage said pin and discharge at least some of said compressed gas; and, an activation subassembly comprising a means for holding connected to both ends of a triggering device subassembly, said means for holding configured to hold said spring in an armed static condition by compression as long as said triggering device remains in the armed condition, wherein said cylinder subassembly further comprises:

a cap, including a means for engaging said spring, detachably connected to a first end of said cylinder;

a base plate, including a means for engaging said spring, positioned at the second end of said cylinder; and, at least one restraining arm rotatably connected to the base plate at one of its ends and the cap at its other end;

wherein said spring is positioned between the cap and base plate, at least partially compressed, and held as compressed by said restraining arms.

* * * * *